US008082716B1

(12) United States Patent
Worley et al.

(10) Patent No.: US 8,082,716 B1
(45) Date of Patent: Dec. 27, 2011

(54) ROOFING TILE SYSTEM

(76) Inventors: Ronald J. Worley, Tequesta, FL (US); Harry Robinson, Loxahatchee, FL (US)

( * ) Notice: Subject to any disclaimer, the term of this patent is extended or adjusted under 35 U.S.C. 154(b) by 303 days.

(21) Appl. No.: 12/389,329

(22) Filed: Feb. 19, 2009

(51) Int. Cl.
*E04D 1/00* (2006.01)

(52) U.S. Cl. ..... 52/549; 52/520; 52/551

(58) Field of Classification Search ..... 52/518, 52/520, 543, 546, 549, 551, 552
See application file for complete search history.

(56) References Cited

U.S. PATENT DOCUMENTS

| | | | | | |
|---|---|---|---|---|---|
| 1,202,729 | A | * | 10/1916 | Nilsson | 52/543 |
| 3,835,609 | A | * | 9/1974 | Oscar | 52/478 |
| 4,182,090 | A | | 1/1980 | Aarons | |
| 4,314,433 | A | * | 2/1982 | Hulcombe | 52/521 |
| 4,544,595 | A | | 10/1985 | Tomason | |
| 4,599,828 | A | * | 7/1986 | Ishikura | 52/19 |
| 4,729,202 | A | | 3/1988 | Ferland | |
| 4,765,113 | A | | 8/1988 | Jong | |
| 4,787,190 | A | * | 11/1988 | Papsdorf | 52/553 |
| 4,914,885 | A | | 4/1990 | Baker et al. | |
| 5,048,255 | A | * | 9/1991 | Gonzales | 52/533 |
| 5,337,529 | A | | 8/1994 | Lutin et al. | |
| 5,651,226 | A | * | 7/1997 | Archibald | 52/518 |
| 5,722,212 | A | | 3/1998 | Struve et al. | |
| 7,178,301 | B2 | * | 2/2007 | Albright | 52/543 |
| 2004/0123544 | A1 | * | 7/2004 | Simmons et al. | 52/519 |
| 2007/0094948 | A1 | | 5/2007 | Osborne et al. | |

FOREIGN PATENT DOCUMENTS

| | | | |
|---|---|---|---|
| EP | 0396380 | | 11/1990 |
| EP | 0694658 | | 1/1996 |
| GB | 2202245 | A * | 9/1988 |
| WO | WO 9322523 | A1 * | 11/1993 |

* cited by examiner

*Primary Examiner* — Brian Glessner
*Assistant Examiner* — Adriana Figueroa
(74) *Attorney, Agent, or Firm* — Gold & Rizvi, P.A.; Glenn E. Gold; H. John Rizvi

(57) ABSTRACT

A roofing tile system provides a secure covering for a building roof and comprises a plurality of rigid tiles attached on a pitched roofing substrate in multiple interlocked rows of tiles. Each tile includes a protected end partially overlapped by another tile in an adjacent row, and an exposed end. The protected end of each tile includes at least one attachment hole and at least one anchoring panel. The exposed end of each tile includes at least one interlock hole. Primary roofing screws are provided for driving through attachment holes and into the substrate for attaching tiles in side-by-side relation to form multiple rows. Secondary roofing screws are provided for driving through interlock holes and into the interlock panel of a partially overlapped tile in an adjacent row, for interlocking the exposed ends of the roofing tiles with anchoring panels in adjacent tiles.

20 Claims, 11 Drawing Sheets

ROOFING TILE SYSTEM

BACKGROUND OF THE INVENTION

1. Field of the Invention

The invention generally relates to roofing tiles and more particularly to a system including a plurality of partially overlapping rows of roofing tiles in side-by-side relation on a pitched roof, with neighboring roofing tiles in adjacent rows interlocked.

2. Description of the Prior Art

A building roof typically includes a layer of rigid material attached to joists or beams to form planar substrates. The roof is made weather tight by the application, on the substrates, of weather proof material having provisions for positive drainage. A typical arrangement is a pitched roof consisting of one or more sections of planar substrates, pitched at an angle to promote downward run-off from an uppermost edge toward a lowermost edge. Uppermost edges of adjacent sections may meet at a peak defined by the boundary between the sections. Each roof section is typically covered by weather proof tiles attached in overlapping rows of tiles in side-by-side relation. Each row of tiles overlaps neighboring tiles in the next lower row. Gaps between adjacent side edges of tiles forming a row are usually partially covered by an intermediate portion of a tile in the next row upward. The peak is covered by curved tiles having opposed lower side edges and a higher central ridge, which curved tiles direct draining water downward onto each of the adjacent roof sections.

Roofing tiles may be formed of rigid or flexible material but in either case, it is common practice to attach the tiles by driving a fastener, such as a roofing nail, through the tile, at a location proximate to the uppermost end, and into the substrate. A first row of tiles is attached at the lowermost edge of a roof section, in side-by side relation. A next row of tiles is attached in the same manner partially overlapping the first row and protecting the uppermost end by covering the holes through which the fasteners pass into the substrate. It is necessary to cover the holes so that water leaks will be avoided, when water drains downward across the roofing tiles. The area of each of the roofing tiles proximate to the lower end, is exposed, while the area proximate to the upper end, including the holes, is protected by the next upper row of tiles. The exposed ends of the tiles are not known to be attached by a fastener.

A moderate wind may cause movement of the exposed ends of flexible roofing tiles. The movement is characterized by flexing of the tiles. The flexing movement absorbs the force exerted by the wind and the protected ends of the tiles may or may not transmit appreciable force to the roofing nails holding the tiles in place. Flexible tiles are known to tear from the secured section or break free in sheets when exposed to a strong enough wind. Rigid roofing tiles are typically heavier than flexible tiles and remain stationary in moderate winds. The rigid roofing systems are generally substantially more costly than flexible roofing systems and are expected to have a significantly longer useful life.

In high winds, the exposed ends of rigid roofing tiles are also moved. The tiles do not flex and the movement is transmitted to the area proximate to the protected ends and force is applied to the roofing nails. The nails may become dislodged causing tiles to slide or become free from their position exposing the roof to possible leaks and tile breakage. There is a need for a system, which provides for areas of the tiles proximate to the exposed ends to be attached, thus preventing movement. There is a need for a system including means for interlocking adjacent rows of tiles for a more secure roof.

SUMMARY OF THE INVENTION

The present invention is directed to a roofing tile system including a plurality of tiles configured for attachment in partially overlapping rows of tiles arranged in side-by-side relation on a substrate of a pitched roof. The system includes a plurality of weather proof tiles, a plurality of primary fasteners, and a plurality of secondary fasteners. Each of the tiles includes a protected end, an exposed end, and two side edges. Each tile is provided with one or more attachment holes proximate to the protected end, for receiving primary fasteners. Each of the tiles is provided with one or more anchoring panels, affixed by engagement means, proximate to the protected end, for receiving secondary fasteners. Each of the tiles is provided with one or more interlock holes, located proximate to the exposed end and positioned to register with one or more of the anchoring panels in a tile in an adjacent overlapped row of tiles.

Primary fasteners may be driven through attachment holes, in a first row of tiles, and into the substrate, to attach a first row of tiles, in side-by-side relation. Next, primary fasteners may be driven through attachment holes in a second row of tiles and into the substrate to attach a second row of tiles in side-by-side relation partially overlapping said first row of tiles. Secondary fasteners may be driven through the interlock holes, in the second row of tiles and into the anchoring panels in the first row of tiles, to interlock the first and second rows of tiles. Subsequent rows of tiles may be attached by driving primary fasteners through attachment holes and into the substrate and secondary fasteners may be driven through interlock holes and into anchoring panels in each preceding row of tiles to interlock each row of tiles with the preceding row. The system of the present invention provides means for interlocking the rows of roofing tiles on a section of roofing substrate. The primary fasteners may be nails or screws and the secondary fasteners are preferably screws. The roofing system of the present invention may be installed using conventional fasteners and conventional tools.

An object of the present invention is to provide a roofing tile system which can be attached on a pitched roof substrate in partially overlapped interlocked rows of tiles in side-by-side relation.

Another object of the present invention to provide a roofing system of interlocked rows of tiles in side-by-side relation, which can be installed in a conventional manner using conventional tools.

It is yet another object of the present invention to provide a roofing tile system of interlocked rows of tiles in side-by-side relation, which is secure in a high wind.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention.

Figure 1:
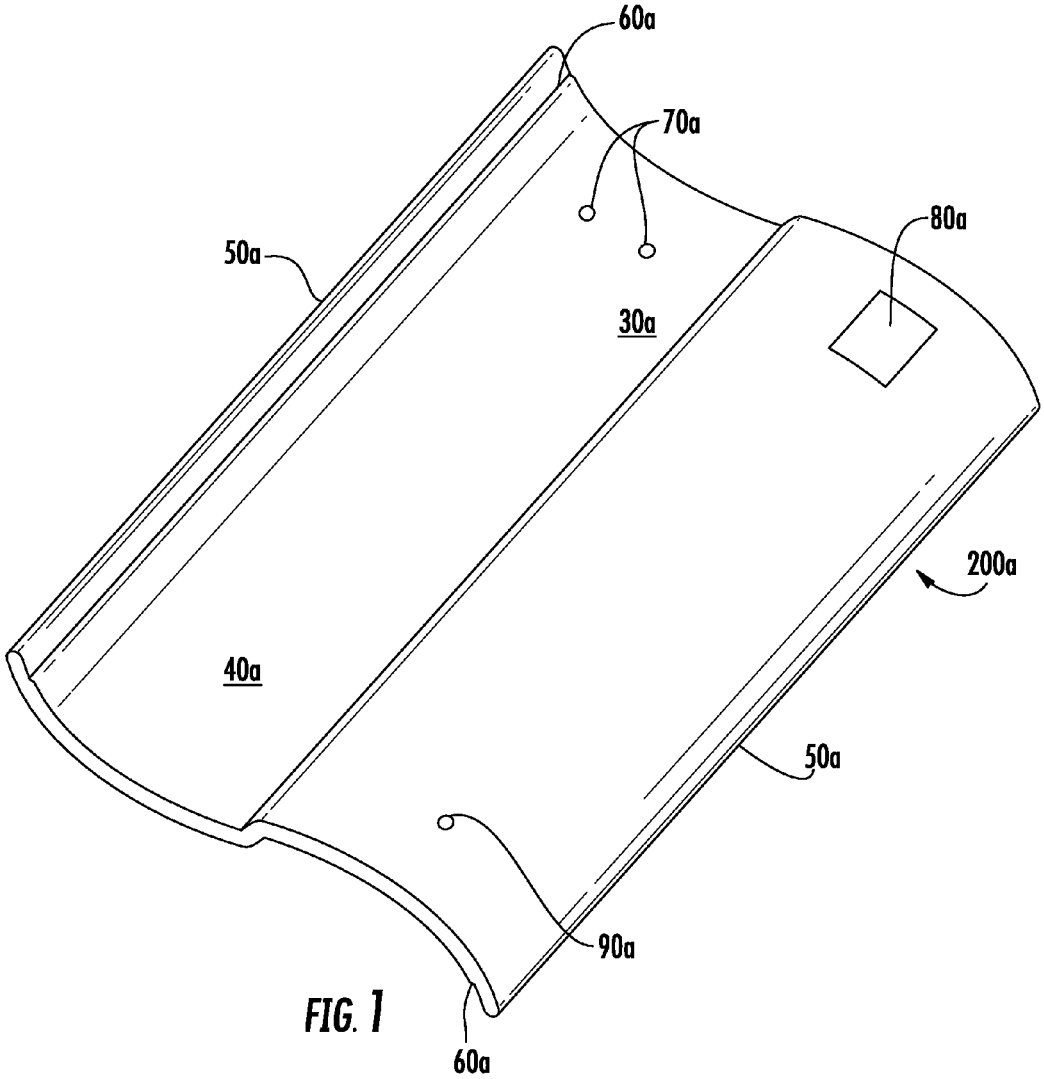
FIG. 1 is a perspective view of an "S" shaped or double curve roofing tile of the present invention.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
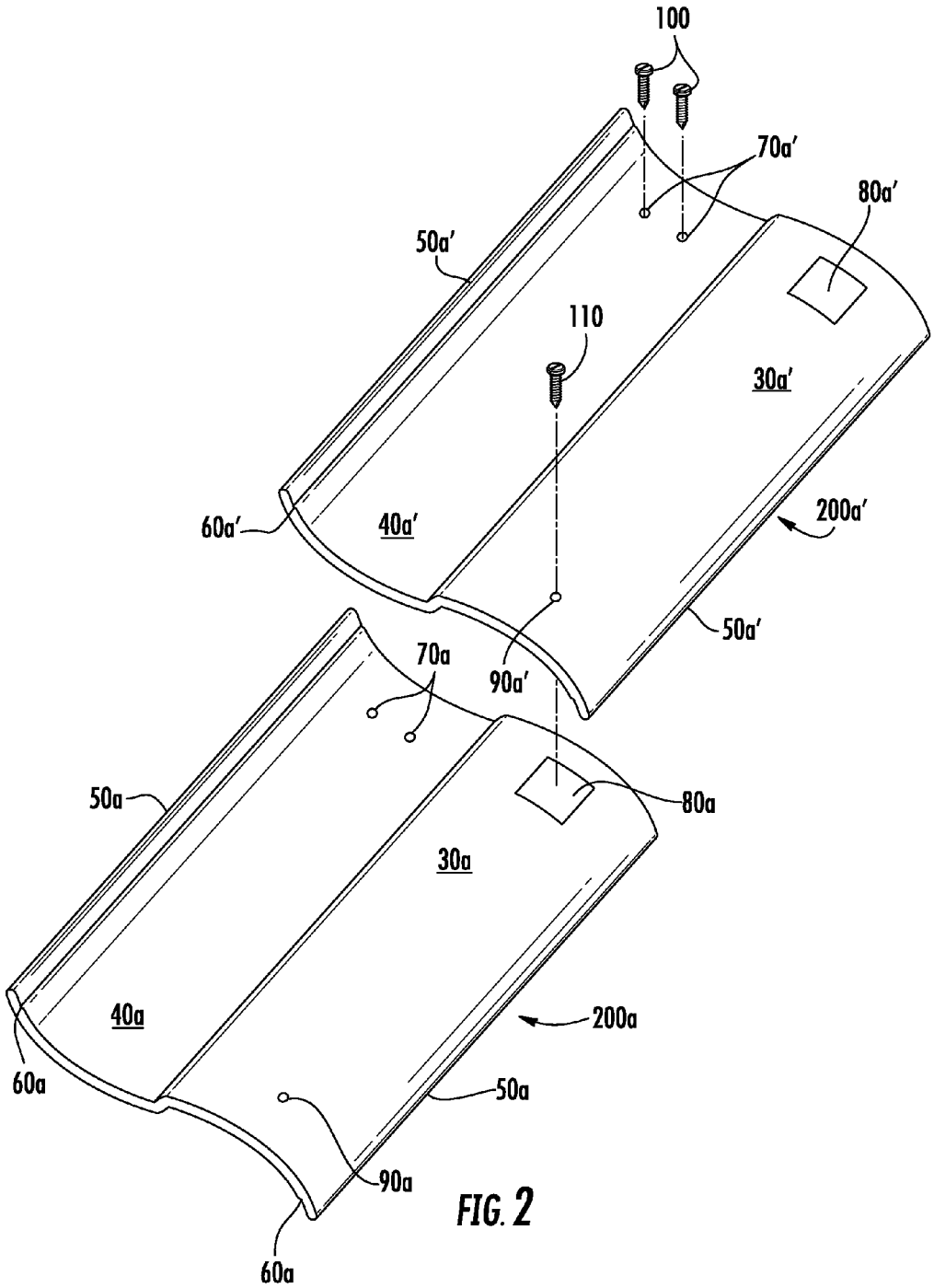
FIG. 2 is an exploded perspective view of two double curve roofing tiles of the present invention in partial overlapping relation.

Shown throughout the drawings, the present invention is generally directed towards a roofing tile system for installation on a pitched roof, which includes a plurality of roofing tiles in partially overlapped and interlocked rows of tiles in side-by-side relation. The rows of tiles are designed for installation on planar sections of roofing substrate with the understanding that multiple adjacent sections of substrate form the roof structure of a building. The system of the present invention is suitable for weatherproof roofing tiles of varied design. Several tile configurations will be used as exemplary embodiments throughout this application. It is understood the roofing tile system can be applied to all molded tile shapes and sizes. An exemplary first large profile "S" shaped curved tile, more broadly referred to as a double curve tile 200*a* is shown in FIG. 1. The first double curve tile 200*a* includes a protected end 30*a* and an exposed end 40*a*. It is intended that the tiles of the present invention, such as the first double curve tile 200*a* be installed on a pitched section of roofing substrate such that the protected end 30*a* is elevated above the exposed end 40*a* by virtue of the slope of the roofing substrate. The first double curve tile 200*a* includes two generally parallel side edges 50*a*. The tiles of the present invention may preferably be installed in conventional manner by attaching a first row of tiles, in side-by-side relation, along a lowermost edge of a pitched section of roofing substrate. It is preferred that the side edges 50*a* of the first double curve tile 200*a* include a formed lip 60*a* parallel to the side edges 50*a* to facilitate alignment of adjacent tiles in side-by-side relation and to provide a partial overlap for maintaining drainage over the upward facing surfaces of the tiles, such as the first double curve tile 200*a* according to conventional practice. The first double curve tile 200*a* includes one or more attachment holes 70*a* proximate to the protected end 30*a*, for attaching the first double curve tile 200*a* to the substrate. The first double curve tile 200*a* also includes an anchoring panel 80*a* and an interlock hole 90*a*. The anchoring panel 80*a* is spaced apart from the attachment holes 70*a* and proximate to the protected end 30*a*. The interlock hole 90*a* is proximate to the exposed end 40*a*. The first double curve tile 200*a* may be interlocked with a neighboring second double curve tile 200*a*', as shown in FIG. 2. The second double curve tile 200*a*' is a duplicate of the first double curve tile 200*a* and includes a protected end 30*a*', an exposed end 40*a*', side edges 50*a*', attachment holes 70*a*', an anchoring panel 80*a*', and an interlock hole 90*a*'.

After attaching a first row of tiles, in side-by-side relation along the lowermost boundary of a pitched section of roofing substrate, a second row of tiles is attached, in side-by-side relation. The second double curve tile 200*a*' is intended to be a member of the second row of tiles intended to be attached such that the exposed end 40*a*' of the second double curve tile 200*a*' overlaps the protected end 30*a* of the first double curve tile 200*a*, a member of the first row. Primary fastening means are provided for driving through the attachment holes 70*a* and 70*a*' of the first and second double curve tiles 200*a* and 200*a*', respectively, and into the roofing substrate, for attaching the tiles. Primary fastening means are preferably selected to have characteristics appropriate for securely gripping the roofing substrate. Conventional roofing nails or primary roofing screws 100 are suitable. FIG. 2 shows primary roofing screws 100 in alignment with the attachment holes 70*a*' of the second double curve tile 200*a*', with a dotted line indicating the path for driving through the attachment holes 70*a*'. It is to be understood that the first double curve tile 200*a* is to be attached with primary fastening means driven through the attachment holes 70*a* in the first double curve tile 200*a* and into the roofing substrate. Secondary fastening means are provided for interlocking the second double curve tile 200*a*' to the first double curve tile 200*a*. Secondary fastening means are preferably a secondary roofing screw 110. A secondary roofing screw 110 is shown in FIG. 2, in alignment with the anchoring panel 80*a* of the first double curve tile 200*a* and also with the interlock hole 90*a*' of the second double curve tile 200*a*', which interlock hole 90*a*' is located so as to register with the anchoring panel 80*a* of the first double curve tile 200*a*, in the partially overlapping relation typical of conventional practice for attaching roofing tiles. The system of the present invention may be adapted for broader roofing tiles by including additional interlock holes in each tile and multiple anchoring panels positioned to register with the interlock holes.

Figure 3:
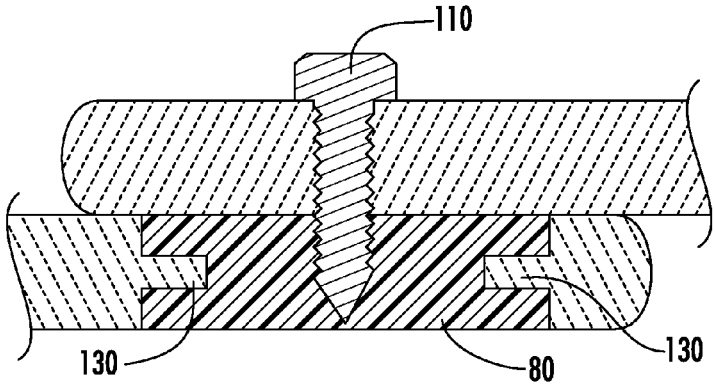
FIG. 3 is a partial elevation cross-section view of roofing tiles of the present invention in partial overlapping relation.

The secondary roofing screw 110 is selected to have favorable characteristics for gripping the anchoring panel 80*a* and also is selected to have a length sufficiently long to firmly grip the anchoring panel 80*a* but not so long as to allow penetration through the anchoring panel 80*a*, as shown in FIG. 3. Self threading square head drive screws are suitable for secondary roofing screws 110 and for convenience, the same screws may serve as primary fastening means; however, conventional roofing nails, which are more economical, are also suitable, as primary fastening means.

Figure 4:
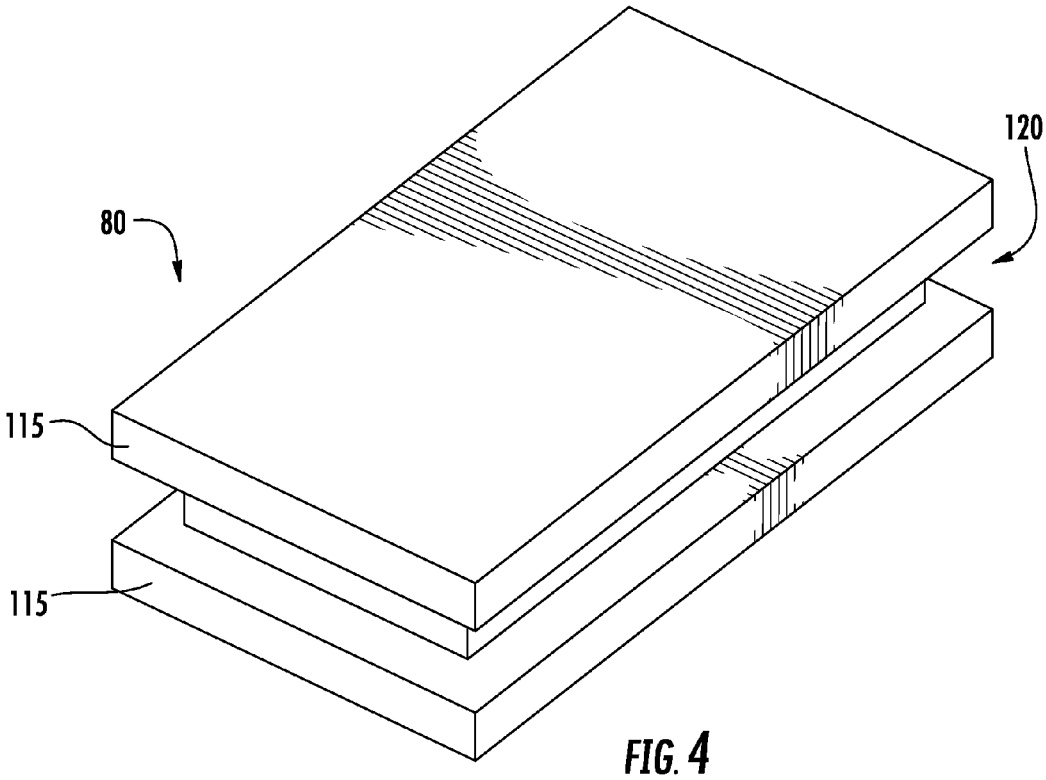
FIG. 4 is a perspective view of an anchoring panel of the present invention.
Figure 5:
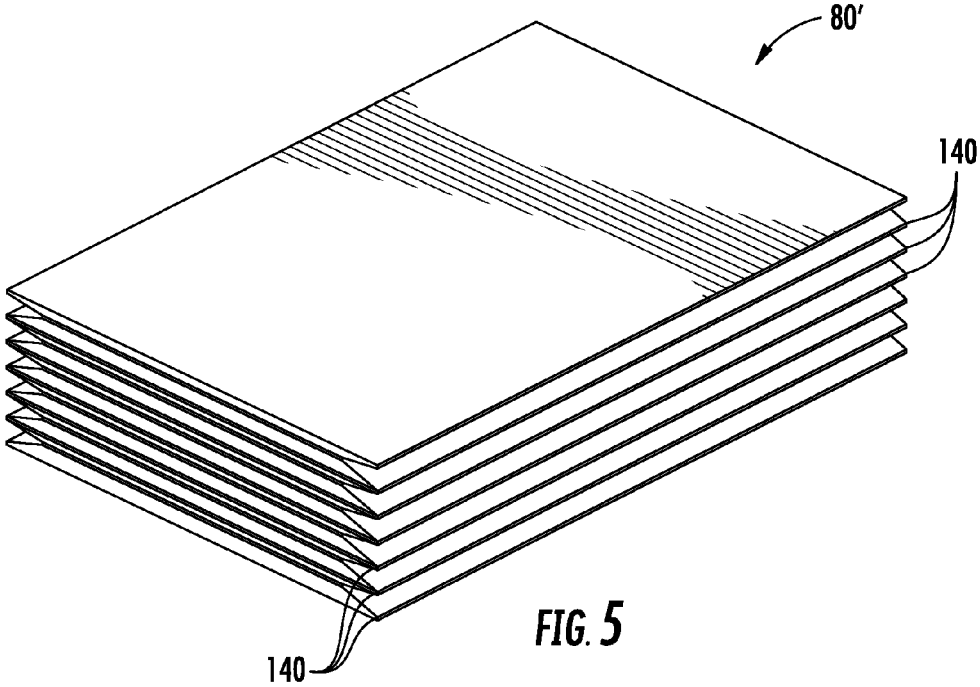
FIG. 5 is a perspective view of a first alternate embodiment anchoring panel of the present invention.
Figure 6:
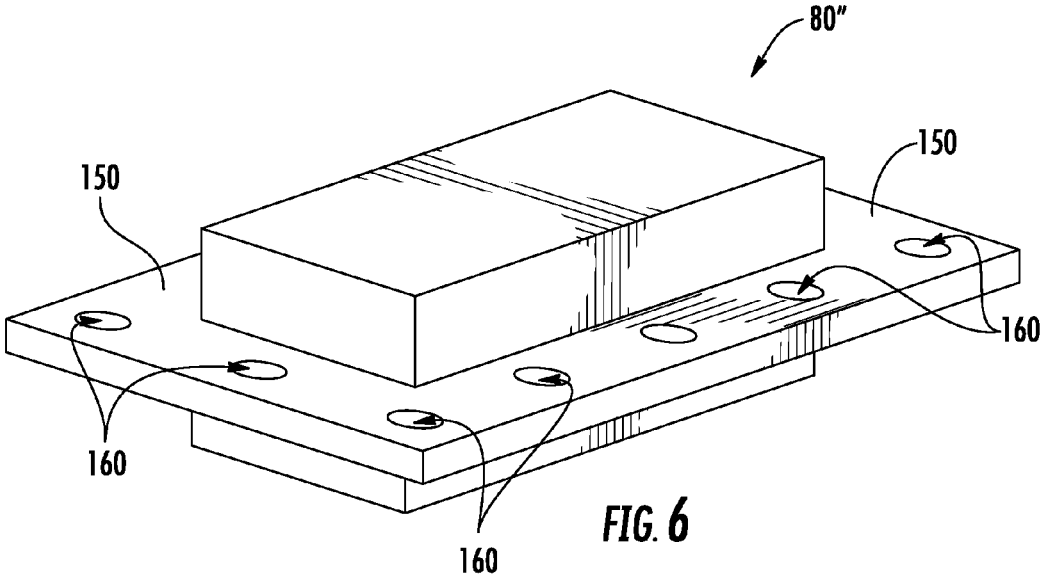
FIG. 6 is a perspective view of a second alternate embodiment anchoring panel of the present invention.
Figure 7:
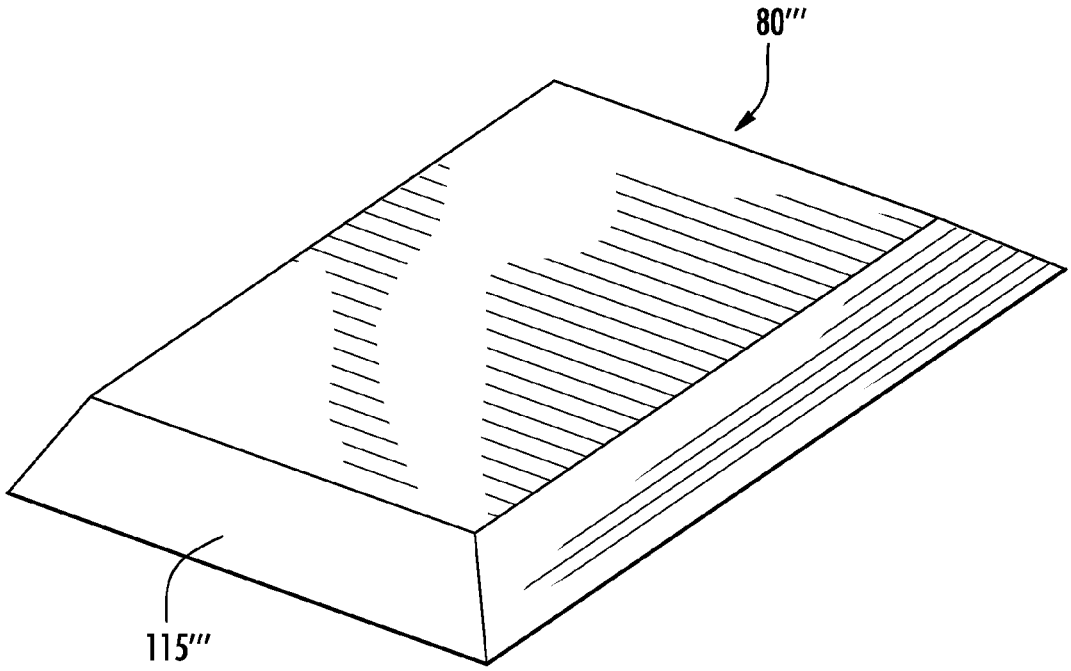
FIG. 7 is a perspective view of a third alternate embodiment anchoring panel of the present invention.

An exemplary anchoring panel 80, shown in detail in FIG. 4, is retained by engagement means, within an aperture of complementary shape, provided in a roofing tile of the present invention, shown in FIG. 3, such as the double curve tiles 200*a* and 200*a*' shown in FIGS. 1 and 2. The anchoring panel 80 is a body having a shape and volume selected to be received within the aperture with opposed parallel surfaces configured to lie flush with opposed surfaces of the tile, and a perimeter facet 115 adjacent to an inner aspect of the aperture, as shown in FIG. 3. The opposed surfaces of the anchoring panel 80 are depicted in a rectangular shape but it will be appreciated that other two dimensional shapes would serve as well. The anchoring panel 80*a* is preferably preformed and subsequently insert molded into the tile 200*a*. The anchoring panel 80*a* can alternately be formed of compressible and resilient material, which will forcibly expand to exert stabilizing tension on the inner aspect of the aperture. The selected material is also preferably rigid so as to resist flexing as secondary fastening means are driven. Examples of the material include: a plastic material, a composite material, a synthetic material, a copolymer based material, a semi-crystalline polymer based material, a resin based material, Polyoxymethylene, and the like. Engagement means may comprise a tongue and groove arrangement consisting of a groove 120, in the perimeter facet 115 and a complementary tongue 130 formed on the inner aspect of the aperture of the tile, as shown in FIG. 3. Engagement means may include a first alternate anchoring panel 80' as shown in FIG. 5, formed of the same material and having a plurality of parallel finger webs 140 defining a plurality of interstitial valleys for receiving complementary perimeter ridges (not shown) which may be formed on the inner aspect of the aperture of a tile. FIG. 6 shows engagement means on a second alternate anchoring panel 80" having a perimeter flange 150 having a plurality of wells 160 about the flange 150 designed to receive a corresponding plurality of bosses (not shown) formed about a perimeter channel (not shown) on the inner aspect of the aperture of a tile. FIG. 7 shows a third alternate anchoring panel 80'" being a body having the shape of a square pyramid base, with a canted perimeter facet 115'" and being designed to be retained in a tile by engagement means such as being insert molded or via an adhesive applied between the perimeter facet 115'" and a corresponding canted inner aspect of the aperture on the third alternate anchoring panel 80'" which may be received into the tapered aperture. It will be appreciated that other similar engagement means may be employed.

Figure 8:
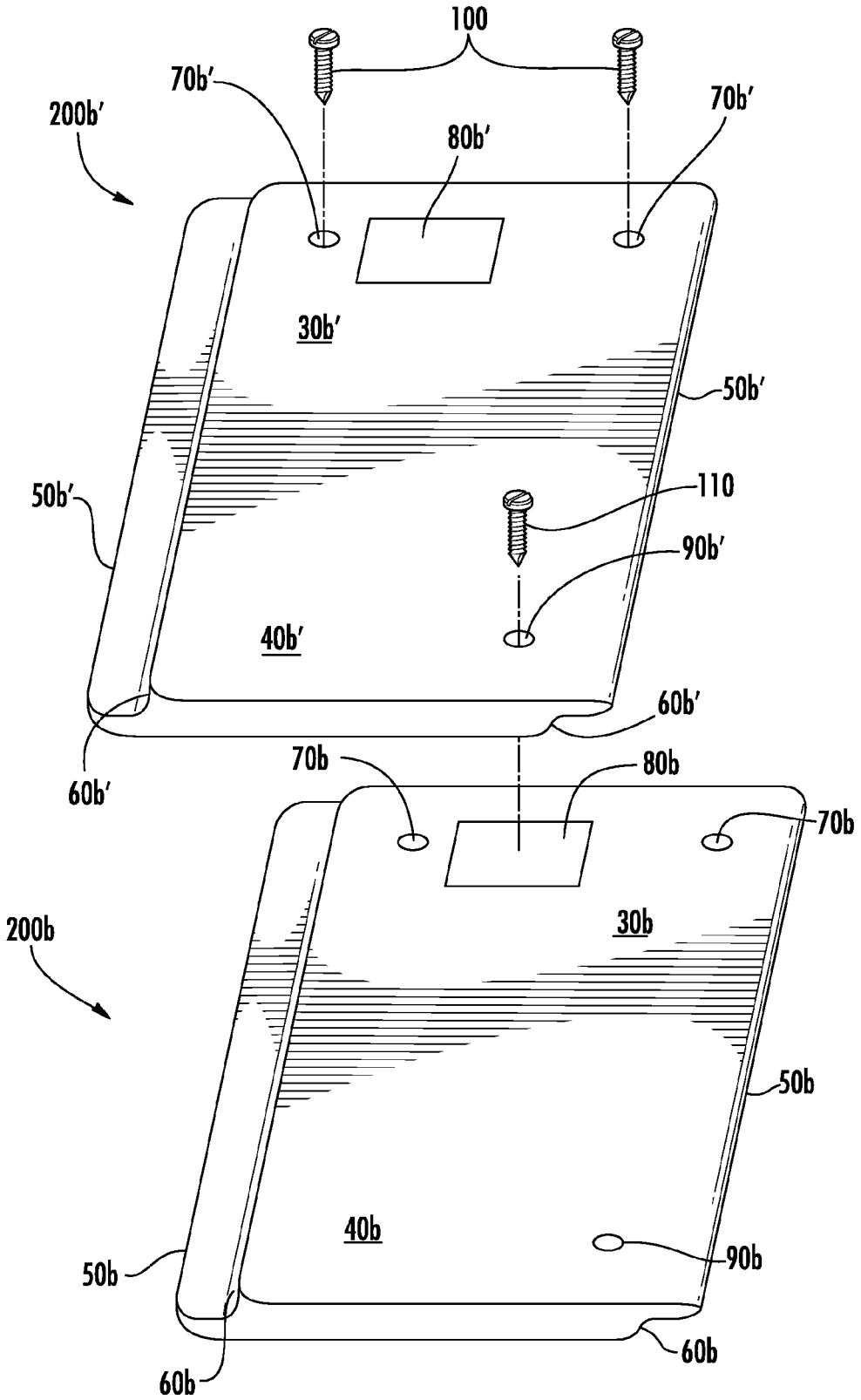
FIG. 8 is an exploded perspective view of two flat roofing tiles of the present invention in partial overlapping relation.
Figure 9:
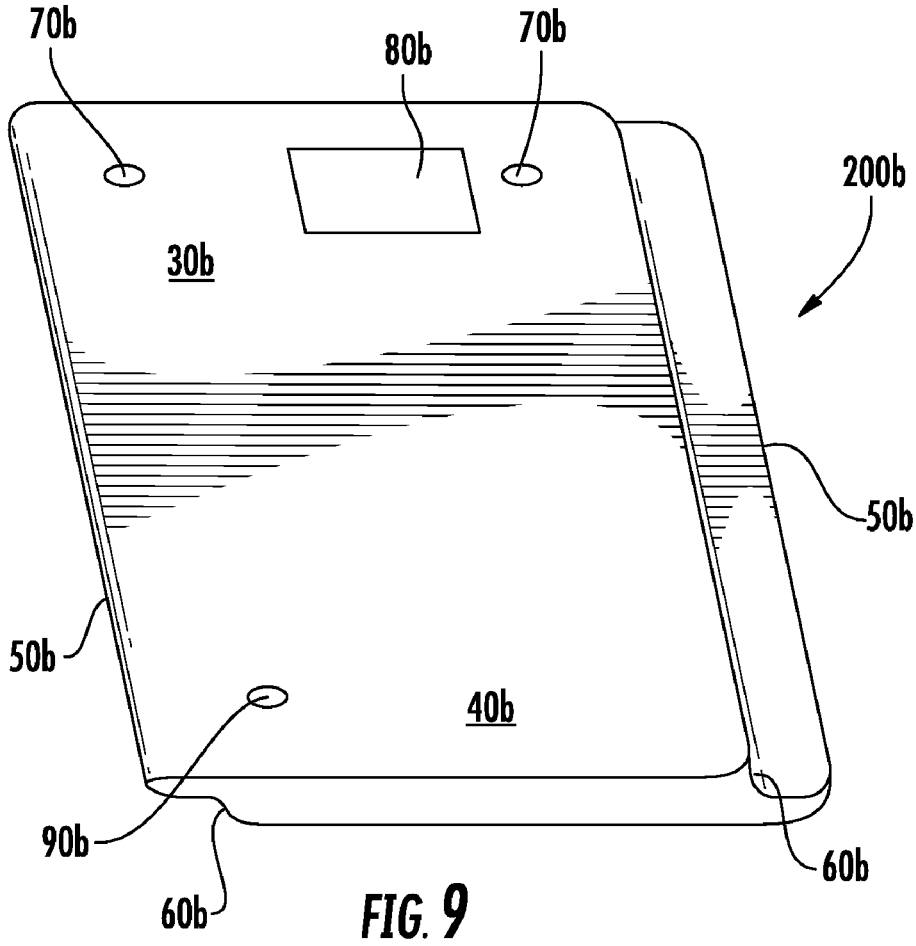
FIG. 9 is a reverse perspective view of a flat roofing tile of the present invention.

Exemplary first flat roofing tile 200*b* and second flat roofing tile 200*b*' are shown in FIG. 8. First and second flat roofing tiles 200*b* and 200*b*' include a protected end 30*b* and 30*b*', an exposed end 40*b* and 40*b*', side edges 50*b* and 50*b*', attachment holes 70*b* and 70*b*', an anchoring panel 80*b* and 80*b*', and an interlock hole 90*b* and 90*b*'. The first flat tile 200*b* is intended to be a member of a first row of tiles attached to a roofing substrate in side-by-side relation. The second flat tile 200*b*' is intended to be a member of a second row of tiles attached to the roofing substrate in side-by-side relation and partially overlapping the first row. The side edges 50*b* of the first flat tile 200*b* and the second flat tile 200*b*' are each provided with a lip 60*b* to engage adjacent tiles in the row. Primary fastening means, such as primary roofing screws 100 are shown in position for driving through attachment holes 70*b*' in the second flat tile 200*b*' along the path indicated by a dotted line, penetrating the substrate to attach the second flat tile 200*b*'. Likewise, the first flat tile 200*b* is to be attached to the substrate by primary fastening means, such as first roofing screws (not shown). The second flat tile 200*b*' is interlocked with the first flat tile 200*b* by secondary fastening means, such as a secondary roofing screw 110 driven through the interlock hole 90*b*' in the second flat tile 200*b*' and into the anchoring panel 80*b* in the first flat tile 200*b*. It is to be understood that each of the flat tiles forming the second row of tiles are to be interlocked with an adjacent and partially overlapped tile of the first row to interlock the second row tiles with the first row tiles. Successive rows of tiles would be attached to cover the entire section of roofing substrate, with each successive row of tiles interlocked with the preceding partially overlapped row of tiles. FIG. 9 shows a reverse view of the flat tile 200*b* including a view of one of the opposed surfaces of the anchoring panel 80*b* lying flush with a reverse surface of the first flat tile 200*b*. For ease of construction, an aperture is formed in the tile, but as an alternative, a recess, sized to receive an anchoring panel, which recess does not communicate with the reverse surface of a tile would also serve. It will be appreciated that the anchoring panels shown in roofing or ridge tiles, in FIGS. 1, 2, 8, 9, 10, 11, and 12 may be any of the embodiments of anchoring panel disclosed and claimed herein.

Figure 10:
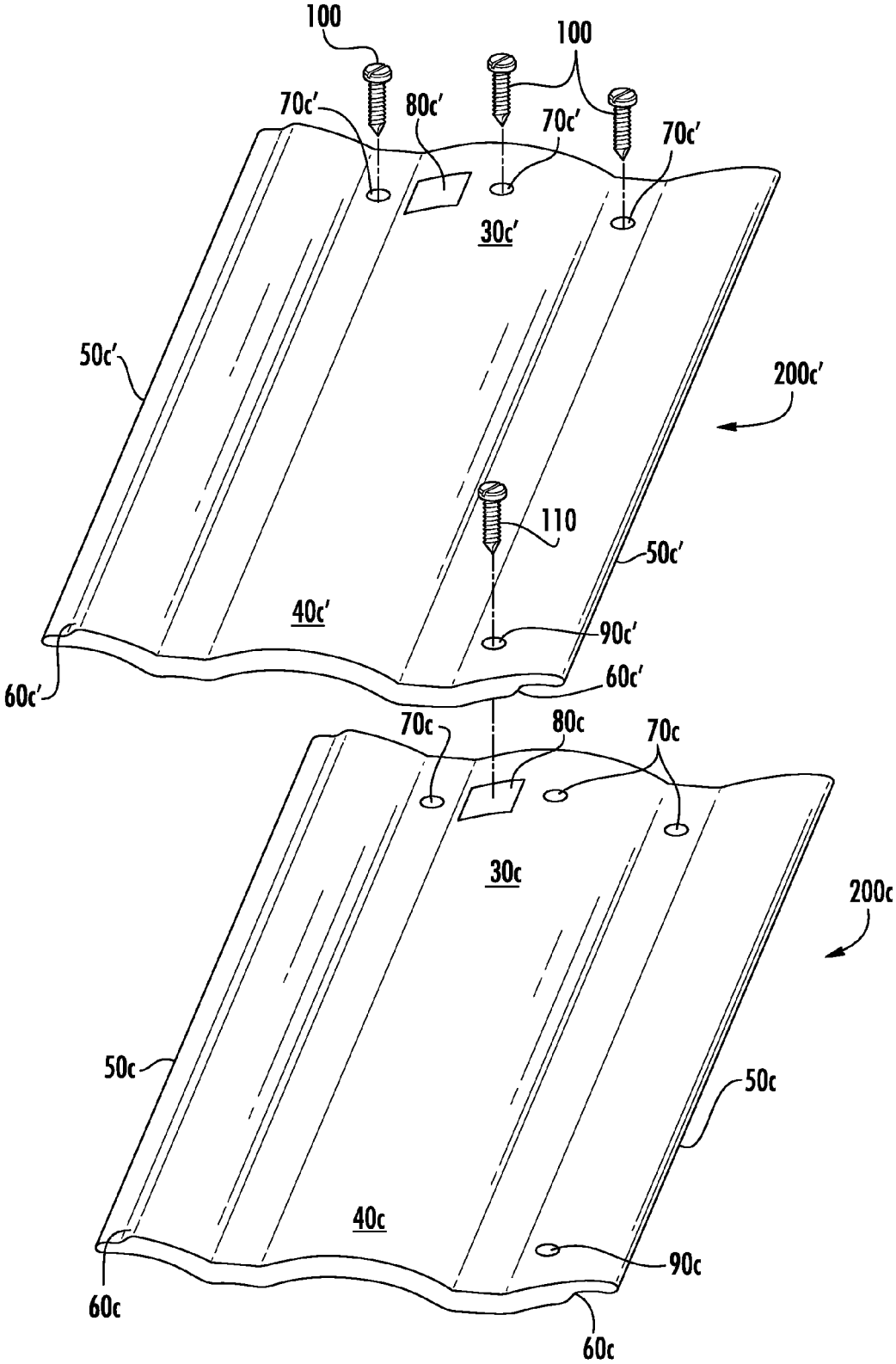
FIG. 10 is an exploded perspective view of two low-profile Spanish style or double roll roofing tiles of the present invention in partial overlapping relation.

FIG. 10 shows an exemplary first low-profile Spanish style tile 200*c* and a second low-profile Spanish style tile 200*c*' (alternately referred to as a double rolled tile) positioned in the same relation as shown in FIG. 8. First and second Spanish style tiles 200*c* and 200*c*' include a protected end 30*c* and 30*c*', an exposed end 40*c* and 40*c*', side edges 50*c* and 50*c*', attachment holes 70*c* and 70*c*', an anchoring panel 80*c* and 80*c*', and an interlock hole 90*c* and 90*c*'. The system of the present invention is to be employed as set forth above to provide interlocking rows of tiles in side-by-side relation covering sections of roofing substrate.

Figure 11:
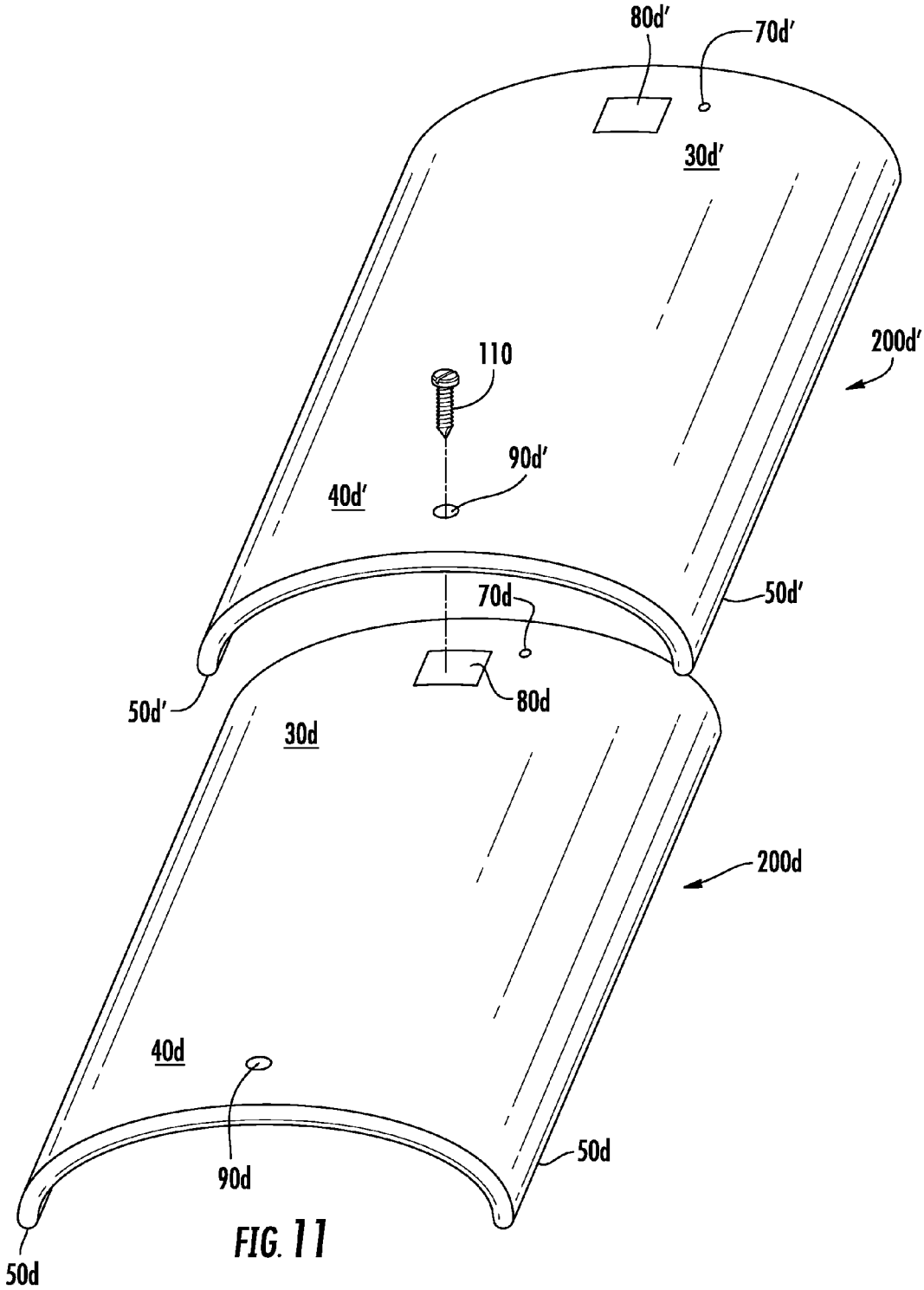
FIG. 11 is an exploded perspective view of two curved ridge tiles of the present invention in partial overlapping relation.
Figure 12:
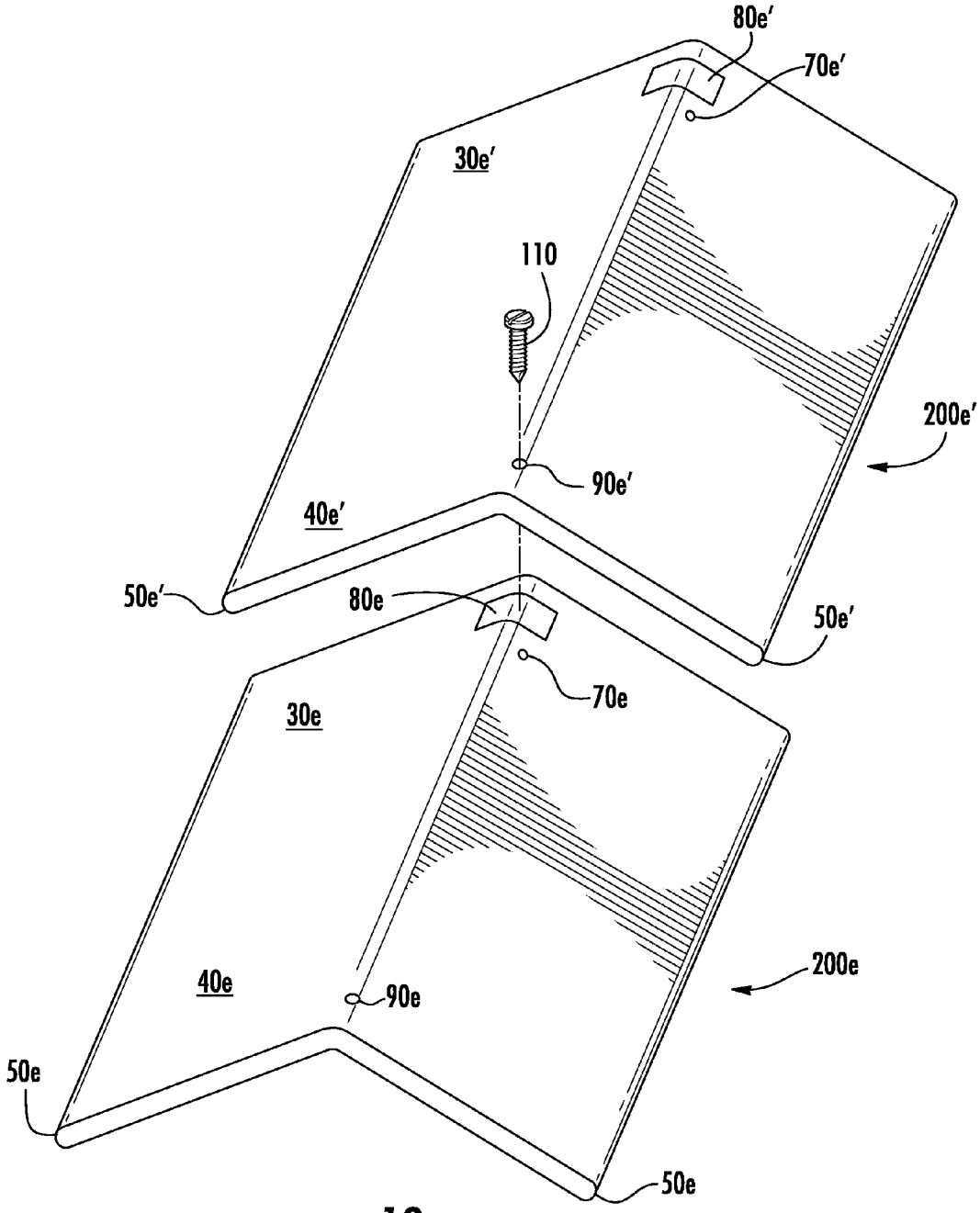
FIG. 12 is an exploded perspective view of two angled ridge tiles of the present invention in partial overlapping relation.

Adjacent sections of roofing substrate, on a pitched roof, meet to form peaks, having a seam between uppermost rows of tiles on each of the sections. FIG. 11 shows an exemplary first curved ridge tile 200*d* and a second curved ridge tile 200*d*', which are to be attached along a roof peak, by primary fastening means (not shown) driven through attachment holes 70*d* and into the substrate. First and second curved ridge tiles 200*d* and 200*d*' include a protected end 30*d* and 30*d*', an exposed end 40*d* and 40*d*', side edges 50*d* and 50*d*', attachment holes 70*d* and 70*d*', an anchoring panel 80*d* and 80*d*', and an interlock hole 90*d* and 90*d*'. The second curved ridge tile 200*d*' partially overlaps the first curved ridge tile 200*d*, as indicated in FIG. 11 and secondary fastening means, such as a secondary roofing screw 110, may be driven along the path indicated by the dotted line, through the interlock hole 90*d*' in the second curved ridge tile 200*d*' and into the anchoring panel 80*d* in the first curved ridge tile 200*d*. Each of the ridge tiles is attached to the roofing substrate by primary fastening means and interlocked with an adjacent partially overlapped ridge tile by secondary fastening means. FIG. 12 shows a first angled ridge tile 200*e* and a second angled roof tile 200*e*' incorporating the features of the present invention, for attachment in the same manner as the first and second curved ridge tiles 200*d* and 200*d*' shown in FIG. 11.

Figure 13:
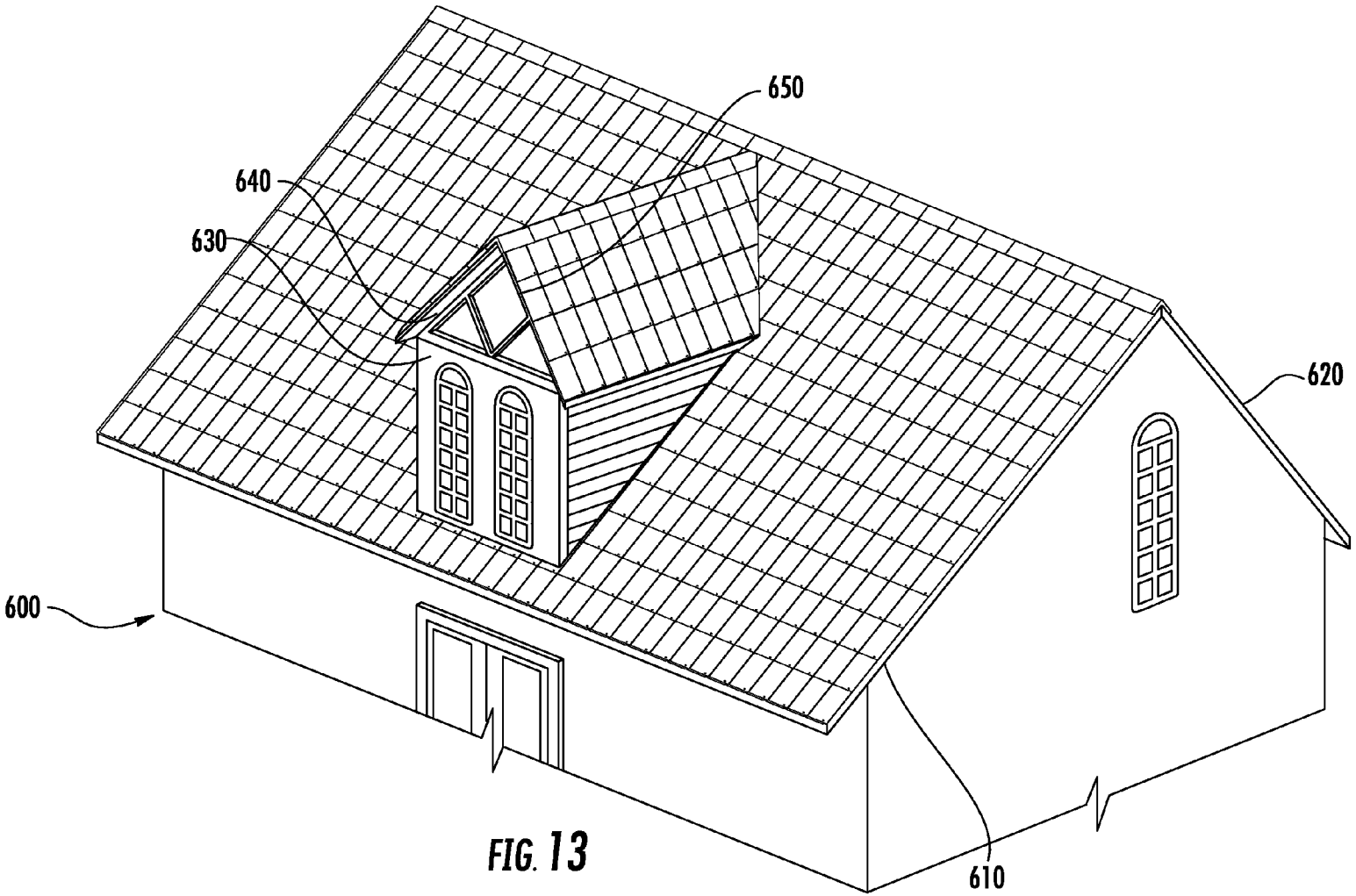
FIG. 13 is a front perspective view of a building with roofing tiles of the present invention installed.

FIG. 13 shows a building 600 with a pitched roof occupying a front substrate section 610 and a rear substrate section 620. The front of the building also includes a dormer 630 with a pitched roof occupying a left substrate section 640 and a right substrate section 650. A plurality of interlocked rows of tiles in side-by-side relation covers each substrate section and a run of interlocked ridge tiles covers the seam at the junction of the front substrate section 610 and rear substrate section 620 and the seam at the junction of the left substrate section 640 and the right substrate section 650. The interlocking feature secures the exposed end 40*a-e* of each of the overlapping tiles and prevents movement of the tiles in high wind conditions, which movement tends to dislodge the tiles and expose the roof underlayment to weather damage and leaking. The heads of the secondary roofing screws 110 may be colored to match the color of the roofing tiles, for aesthetic appeal and the anchoring panels may be likewise colored as well.

While the preferred embodiments of the invention have been described above, it will be recognized and understood that various modifications can be made in the invention and the appended claims are intended to cover all such modifications which may fall within the spirit and scope of the invention.

What is claimed is:

1. A roofing tile system of partially overlapping rows of tiles in side-by-side relation, on a substrate of a pitched roof, said system comprising:

a plurality of weatherproof tiles, a plurality of primary fasteners, and a plurality of secondary fasteners;

each of said tiles having a protected end, an exposed end, and two side edges;

each of said tiles having at least one attachment hole, for receiving primary fasteners;

said attachment holes being located proximate to said protected end;

each of said tiles having at least one anchoring panel, for receiving secondary fasteners;

said anchoring panels being affixed, proximate to said protected end, by engagement means;

each of said tiles having at least one interlock hole;

said interlock holes being located proximate to said exposed end and positioned to register with at least one anchoring panel of a tile in said overlapped row of tiles;

said primary fasteners being driven through said attachment holes in a first row and second row of tiles and into said substrate to attach said first and second rows of tiles, in side-by-side relation; said second row of tiles partially overlapping said first row of tiles; and said secondary fasteners being driven through said interlock holes in said second row of tiles into said anchoring panels in said first row of tiles for interlocking said first and second rows of tiles.

2. The roofing tile system of claim 1, wherein:

said primary fastening means consists of self threading screws; and said secondary fastening means consists of self threading screws.

3. The roofing system of claim 1, wherein said anchoring panel is formed of at least one of:

a) a plastic material, b) a composite material, c) a synthetic material, d) a copolymer based material, e) a semi-crystalline polymer based material, f) a resin based material, and g) Polyoxymethylene.

4. The roofing tile system of claim 1, wherein:

each of said roofing tiles includes an aperture sized to receive said anchoring panel;

said anchoring panel includes a perimeter facet and is received within said aperture, with said perimeter facet adjacent to an inner aspect of said aperture.

5. The roofing tile system of claim 4, wherein:

said engagement means includes a groove, formed in said perimeter facet and a tongue formed on the inner aspect of said aperture;

said tongue is received within said groove to retain said anchoring panel on said tile.

6. The roofing tile system of claim 4, wherein:

said engagement means includes a plurality of finger webs formed on said perimeter facet and a plurality of corresponding ridges formed on the inner aspect of said aperture;

said finger webs and said ridges inter-engage to retain said anchoring panel on said tile.

7. The roofing tile system of claim 4, wherein:

said engagement means includes a flange formed on said perimeter facet and a channel formed on the inner aspect of said aperture;

said flange having a plurality of wells about said flange;

said channel having a plurality of bosses about said channel;

said flange being received within said channel and said bosses being received within said well for retaining said anchoring panel on said tile.

8. The roofing tile system of claim 4, wherein:

said inner aspect of said aperture is canted to taper said aperture and said perimeter facet is canted to correspond with said tapered aperture, for supporting said anchoring panel within said aperture and said engagement means includes at least one of:

a) said anchoring panel having a shape wherein said panel shape is at least partially entrapped within said roofing tile, and b) an adhesive applied to said perimeter facet to said inner aspect of said aperture, for retaining said anchoring panel on said tile.

9. A process for installing a roofing tile system of partially overlapping rows of tiles in side-by-side relation, on a substrate of a pitched roof, said process comprising the steps of:

providing a plurality of weatherproof tiles, a plurality of primary fasteners, and a plurality of secondary fasteners;

each of said tiles having a protected end, an exposed end, and two side edges;

each of said tiles having at least one attachment hole, for receiving primary fasteners;

said attachment holes being located proximate to said protected end;

each of said tiles having at least one anchoring panel, for receiving secondary fasteners;

said anchoring panels being affixed, proximate to said protected end, by engagement means;

each of said tiles having at least one interlock hole;

said interlock holes being located proximate to said exposed end and positioned to register with at least one anchoring panel of a tile in said overlapped row of tiles;

driving said primary fasteners through said attachment holes in a first row and second row of tiles and into said substrate to attach said first and second rows of tiles, in side-by-side relation; said second row of tiles partially overlapping said first row of tiles; and driving said secondary fasteners through said interlock holes in said second row of tiles into said anchoring panels in said first row of tiles for interlocking said first and second rows of tiles.

10. The process of claim 9, wherein:

said primary fastening means consists of self threading screws; and said secondary fastening means consists of self threading screws.

11. The process of claim 9, wherein said anchoring panel is formed of at least one of:

a) a plastic material,
b) a composite material,
c) a synthetic material,
d) a copolymer based material,
e) a semi-crystalline polymer based material,
f) a resin based material, and
g) Polyoxymethylene.

12. The process of claim 9, wherein:

each of said roofing tiles includes an aperture sized to receive said anchoring panel;

said anchoring panel includes a perimeter facet and is received within said aperture, with said perimeter facet adjacent to an inner aspect of said aperture.

13. The process of claim 12, wherein:

said engagement means includes a groove, formed in said perimeter facet and a tongue formed on the inner aspect of said aperture;

said tongue is received within said groove to retain said anchoring panel on said tile.

14. The process of claim 12, wherein:

said engagement means includes a plurality of finger webs formed on said perimeter facet and a plurality of corresponding ridges formed on the inner aspect of said aperture;

said finger webs and said ridges inter-engage to retain said anchoring panel on said tile.

15. The process of claim 12, wherein:

said engagement means includes a flange formed on said perimeter facet and a channel formed on the inner aspect of said aperture;

said flange having a plurality of wells about said flange;

said channel having a plurality of bosses about said channel;

said flange being received within said channel and said bosses being received within said well for retaining said anchoring panel on said tile.

16. The process of claim 12, wherein:

said inner aspect of said aperture is canted to taper said aperture and said perimeter facet is canted to correspond with said tapered aperture, for supporting said anchoring panel within said aperture and said engagement means includes at least one of:

a) said anchoring panel having a shape wherein said panel shape is at least partially entrapped within said roofing tile, and
b) an adhesive applied to said perimeter facet to said inner aspect of said aperture, for retaining said anchoring panel on said tile.

17. A rigid roofing tile, said tile comprising:

a roofing tile define by a protected end, an exposed end, and two side edges;

said tile having at least one attachment hole;

wherein said at least one attachment hole is located proximate said protected end for receiving primary fasteners;

said tile having at least one anchoring panel for receiving secondary fasteners;

wherein said at least one anchoring panel is affixed, proximate to said protected end, by an engagement means; and said tile having at least one interlock hole formed therethrough;

wherein said at least one interlock hole being located proximate to said exposed end and positioned to register with at least one anchoring panel of a tile when placed onto a roof.

18. The roofing tile of claim 17, wherein said tile is fabricated of at least one of:

a) a concrete based material,
b) a plastic based material, and
c) a clay based material.

19. The roofing system of claim 17, wherein said anchoring panel is formed of at least one of:

a) a plastic material,
b) a composite material,
c) a synthetic material,
d) a copolymer based material,
e) a semi-crystalline polymer based material,
f) a resin based material, and
g) Polyoxymethylene.

20. The roofing system of claim 17, wherein said anchoring panel incorporates a tile engaging feature comprising at least one of:

a) a canted perimeter facet,
b) a groove formed in a perimeter facet of said anchor panel,
c) a plurality of finger webs formed on said perimeter facet of said anchor panel,
d) a flange formed on said perimeter facet,
e) a flange having a series of wells formed on said perimeter facet, and
f) a flange having a series of apertures formed on said perimeter facet.

* * * * *